US007299809B2

(12) United States Patent
Kang

(10) Patent No.: US 7,299,809 B2
(45) Date of Patent: Nov. 27, 2007

(54) DISHWASHER HAVING A LOCK WITH AN ELASTIC COUPLING

(75) Inventor: Myung Ho Kang, Busan (KR)

(73) Assignee: LG Electronics Inc., Seoul (KR)

( * ) Notice: Subject to any disclaimer, the term of this patent is extended or adjusted under 35 U.S.C. 154(b) by 140 days.

(21) Appl. No.: 10/722,449

(22) Filed: Nov. 28, 2003

(65) Prior Publication Data

US 2004/0103928 A1 Jun. 3, 2004

(30) Foreign Application Priority Data

Nov. 28, 2002 (KR) ..... 10-2002-0075061

(51) Int. Cl.
*B08B 3/00* (2006.01)

(52) U.S. Cl. ..... 134/57 DL; 292/DIG. 69; 134/58 DL

(58) Field of Classification Search ..... 134/57 DL, 134/58 DL; 292/DIG. 69
See application file for complete search history.

(56) References Cited

U.S. PATENT DOCUMENTS 987,021 A * 3/1911 Skowronski ..... 292/17
2,153,077 A * 4/1939 Clarke ..... 24/645
2,244,344 A * 6/1941 North et al. ..... 292/18
2,472,498 A * 6/1949 Stone ..... 292/18
2,493,624 A * 1/1950 Gerson ..... 292/17
2,511,998 A * 6/1950 Rummelsburg ..... 292/17
2,526,539 A * 10/1950 Carroll ..... 292/17
2,594,582 A * 4/1952 Quinn ..... 292/18
2,942,905 A * 6/1960 Wootton ..... 292/17
3,133,168 A * 5/1964 Jacobson ..... 200/61.68
3,520,568 A * 7/1970 White et al. ..... 292/255
4,272,111 A * 6/1981 Hammer et al. ..... 292/17
4,510,777 A * 4/1985 Ellingson et al. ..... 68/12.26
5,243,771 A * 9/1993 Kretchman et al. ..... 34/108
6,539,753 B1 * 4/2003 Ito et al. ..... 68/3 R
6,578,587 B2 * 6/2003 Matsuno et al. ..... 134/57 DL
6,954,992 B2 * 10/2005 Hwang ..... 34/108

* cited by examiner

*Primary Examiner*—Michael Barr
*Assistant Examiner*—Sarah E. Husband
(74) *Attorney, Agent, or Firm*—Birch, Stewart, Kolasch & Birch, LLP

(57) ABSTRACT

Disclosed is a dishwasher, by which the dishwasher is simply configured as well as the door is facilitated to open/close. The present invention includes a cabinet having an open front side, a door opening/closing the front side of the cabinet, a locker at the door, a coupling member inside the cabinet to be elastically coupled to or separated from the locker in opening/closing the door, and a switch in rear of the coupling member to sense opening/closing of the door.

14 Claims, 7 Drawing Sheets

DISHWASHER HAVING A LOCK WITH AN ELASTIC COUPLING

This application claims the benefit of Korean Application (s) No. 10-2002-0075061 filed on Nov. 28, 2002 which is/are hereby incorporated by reference.

BACKGROUND OF THE INVENTION

1. Field of the Invention

The present invention relates to a dishwasher, which is simply configured and facilitates to open/close a door.

2. Discussion of the Related Art

Generally, a dishwasher is an apparatus for automatically washing and drying tableware by injecting water and detergent on the tableware. A dishwasher according to a related art is explained by referring to the attached drawings.

FIG. 1 is a perspective view of a dishwasher according to a related art.

Referring to FIG. 1, a dishwasher according to a related art mainly consists of a cabinet 2 having a large open front side, a washing chamber 4 provided in the cabinet 2, and a door 6 opening/closing the open front side of the cabinet 2.

A rack 8 on which tableware is put is provided in the washing chamber 4, and a nozzle 10 injecting water via injection holes 10*a* is rotatably provided under the rack 8.

A sump (not shown in the drawing) is provided under the washing chamber 4 to collect water therein. A pump (not shown in the drawing) pumping water to the nozzle 10 and a heater assembly (not shown in the drawing) for heating water held in the sump are provided in the sump.

Moreover, a blower assembly 12 for blowing out humid air in the dishwasher in progress and a detergent box assembly 14 storing a detergent are provided to an inside of the door 6. And, a gasket (not shown in the drawing) is provided to an inner circumference of the door 6 to make the door adhere closely to cabinet 2 when the door 6 is closed.

Meanwhile, a door lock assembly fixing the door 6 to the cabinet 2 is provided to the door 6 and cabinet 2.

FIG. 2 is a layout of a door lock assembly according to a related art.

Referring to FIG. 2, a door lock assembly according to a related art consists of a grip 22 at the door 6, a locker 24 at the door 6, a holder 26 at the cabinet 2, and a micro switch 32 at the cabinet 2.

The grip 22 is hinge-coupled to the door 6 by a spring (not shown in the drawing). And, the locker 24 is hinge-coupled to the door 6 to be connected to the grip 22.

The holder 26 is coupled to the locker 24 to fix the door 6 to a front side of the cabinet 2. For this, a hole 24*h* in which the holder 26 is inserted is formed at a center if the locker 24, and a tip of the locker 24 inclines so that the holder 26 slides to be inserted in the hole 24*h*.

And, the micro switch 32 is provided in rear of the holder 26 to stop operating the dishwasher in case that the door 6 is open. A button 34 is provided to one side of the micro switch 32. The button 34 is compressed/restored by a link 28 provided to the cabinet 2 to control an operation of the micro switch 32.

An operation of the dishwasher according to the related art is explained as follows.

First of all, when a user holds the grip 22 to push the door 6 to the cabinet 2, the holder 26 slides along the incline tip of the locker 24 to be inserted in the hole 24*h* of the locker 24.

In this case, the tip of the locker 24 moves the link 28 so that the link 28 presses the button 34. Hence, the micro switch 32 is turned on and the dishwasher starts to operate according to a user's command.

Meanwhile, if the user holds to lift up the grip 22 of the door 6 and then pulls the door 6 from the cabinet 2 of the dishwasher in progress, the locker 24 inserted in the holder 26 is released from the holder 26.

In this case, the button 34 is restored to turn off the micro switch 32 as well as the contact between the tip of the locker 24 and the link 28 is released, whereby the dishwasher stops operating.

Hence, even if the door 6 is opened while the washing machine operates, the dishwasher stops operating to prevent an accident from occurring in using the dishwasher.

However, the related art dishwasher is constructed with so many complicated interworking parts such as the grip, locker, holder, link, button, and micro switch.

And, dimensional tolerance and interference of the many parts should be accurately managed, thereby having difficulty in work and part managements.

Moreover, in order to release the locking between the locker and the holder to open the door, the door has to be pulled from the body after the grip has been lifted up, thereby causing inconvenience in using the dishwasher.

SUMMARY OF THE INVENTION

Accordingly, the present invention is directed to a dishwasher that substantially obviates one or more of the problems due to limitations and disadvantages of the related art.

An object of the present invention, which has been devised to solve the foregoing problem, lies in providing a dishwasher, by which the dishwasher is simply configured as well as the door is facilitated to open/close.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a dishwasher including a cabinet having an open front side, a door opening/closing the front side of the cabinet, a locker at the door, a coupling member inside the cabinet to be elastically coupled to or separated from the locker in opening/closing the door, and a switch in rear of the coupling member to sense opening/closing of the door.

In this case, the coupling member preferably includes at least one plate spring. The coupling member includes first and second coupling members to be brought contact with both sides of the locker, respectively. And, two pairs of fixing protrusions are formed inside the cabinet and both ends of the first and second coupling members are hooked to be coupled to the fixing protrusions, respectively.

Moreover, guides are provided to circumferences of both of the ends of the first and second coupling members to prevent the first and second coupling members from being separated from the fixing protrusions, respectively.

Meanwhile, a pair of incline coupling pieces are provided to both of the sides of the locker, respectively and a pair of protrusions brought elastic contact with the coupling pieces are formed at centers of the first and second coupling members, respectively. In this case, a front end of each of the coupling pieces preferably inclines slower than a rear end thereof.

And, fixing protrusions are formed inside the cabinet and both ends of the coupling member are hooked to be coupled to the fixing protrusions, respectively. In this case, guides are provided to circumferences of the both ends of the coupling member to prevent the coupling member from being separated from the fixing protrusions, respectively.

Meanwhile, an incline coupling piece is provided to one side of the locker and a protrusion brought elastic contact with the coupling piece is formed at a center of the coupling member. In this case, a front end of the coupling piece to be brought sliding contact with the coupling member preferably inclines slower than a rear end of the coupling piece to be caught on the protrusion of the coupling member.

Meanwhile, the switch assembly includes a micro switch sensing the opening/closing of the door to control an operation of the dishwasher and a button at one side of the micro switch to transfer operation information of the door to the micro switch.

And, the button is directly brought contact with the locker when the door is closed.

In another aspect of the present invention, there is provided a door lock assembly of a dishwasher including a locker at a door opening/closing a front side of a cabinet, a coupling member inside the cabinet to be elastically coupled to or separated from the locker in opening/closing the door, and a switch in rear of the coupling member to sense opening/closing of the door.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
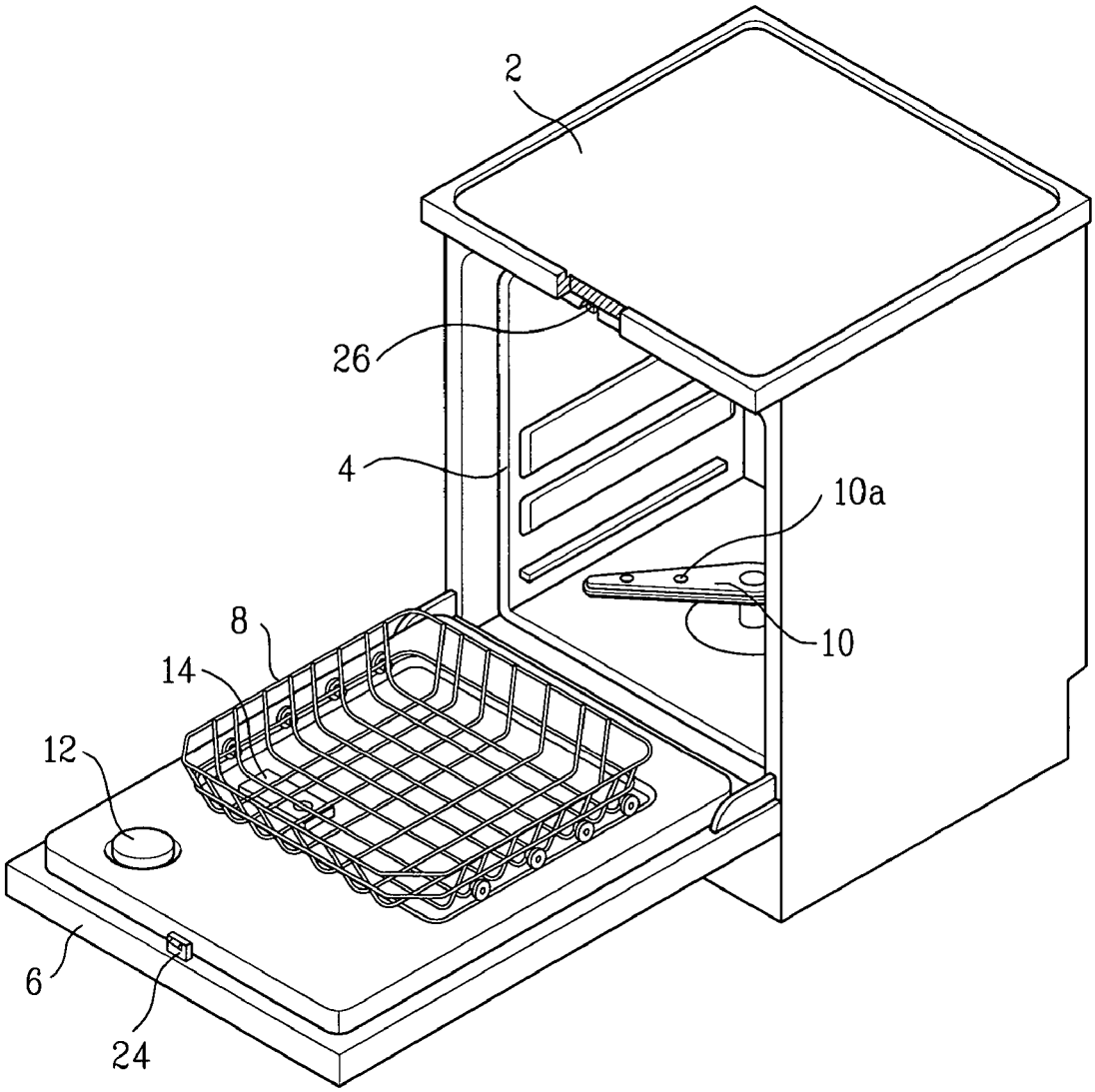
FIG. 1 is a perspective view of a dishwasher according to a related art.
Figure 2:
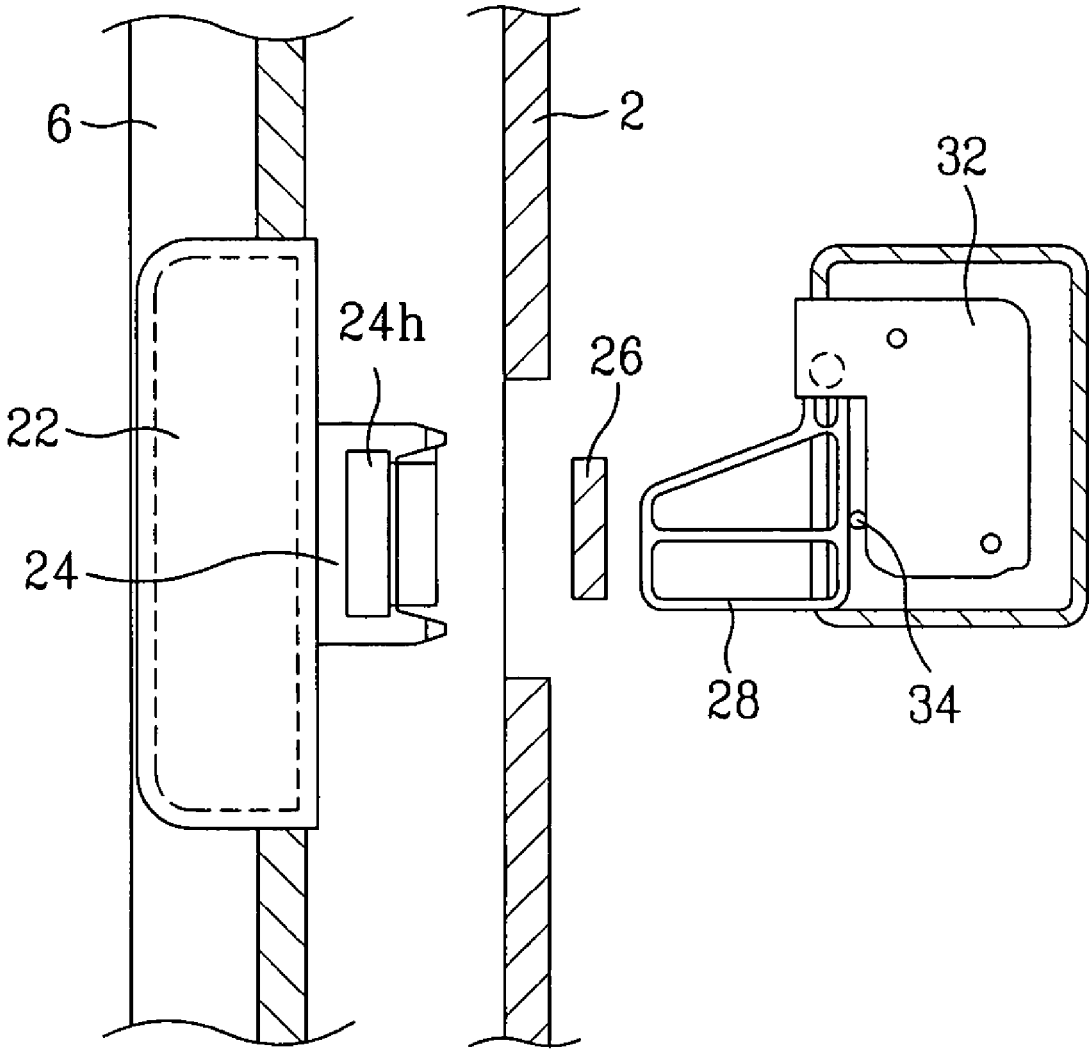
FIG. 2 is a layout of a door lock assembly according to a related art.
Figure 3:
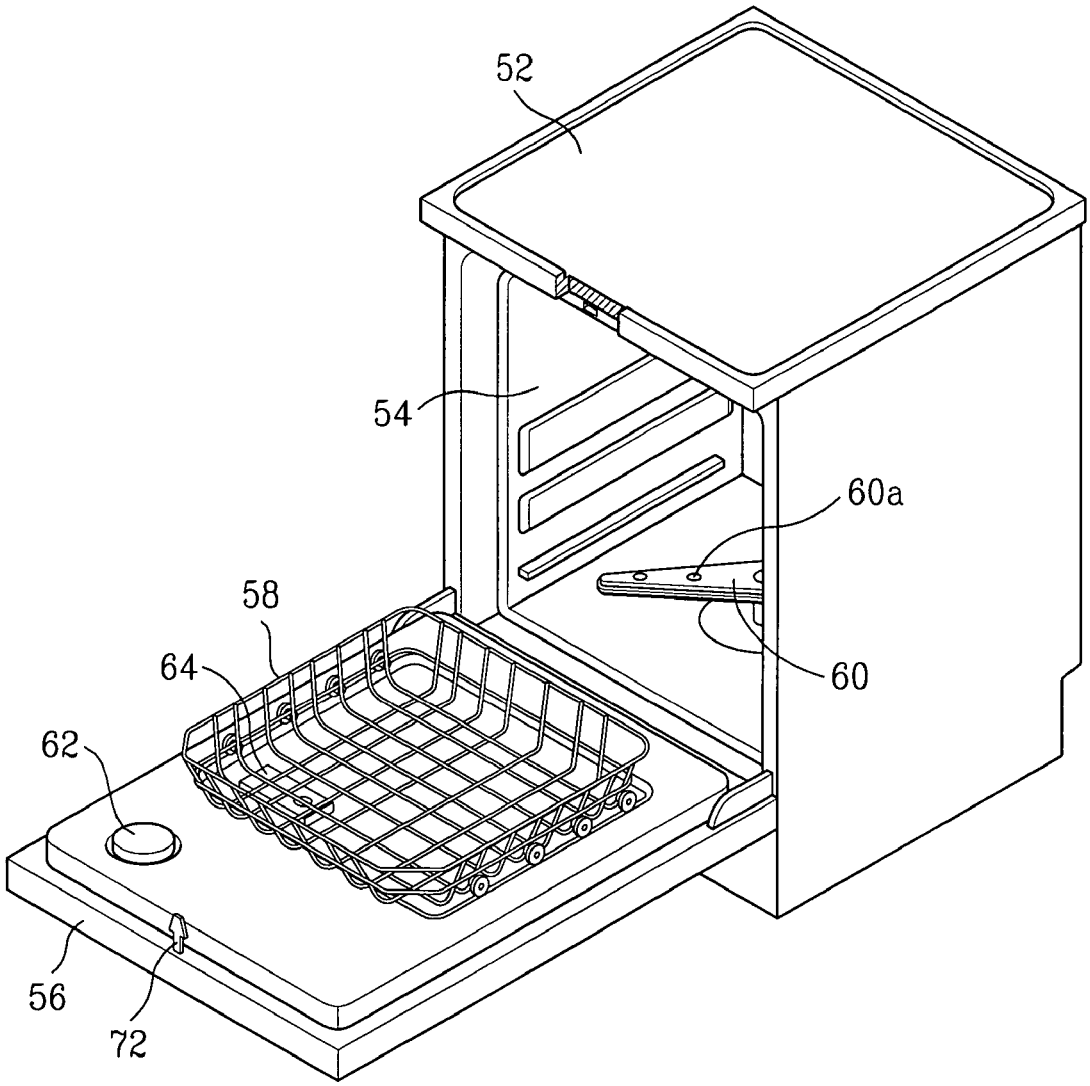
FIG. 3 is a perspective view of a dishwasher according to the present invention.
Figure 4:
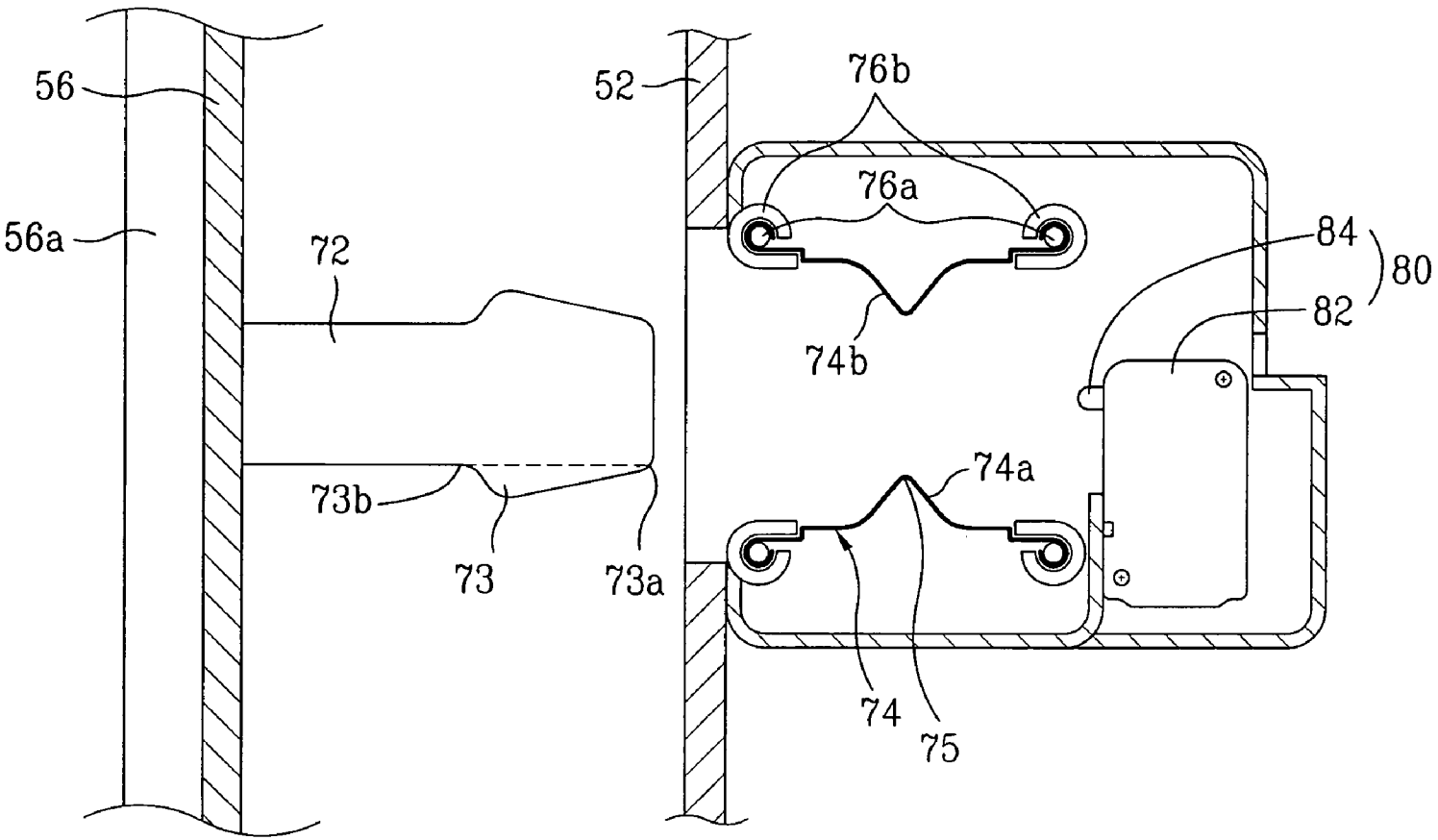
FIG. 4 is a layout of a door lock assembly according to the present invention.

FIG. 3 is a perspective view of a dishwasher according to the present invention and FIG. 4 is a layout of a door lock assembly according to the present invention.

Referring to FIG. 3 and FIG. 4, a dishwasher according to the present invention mainly includes a cabinet 52 having a large open front side, a washing chamber 54 provided in the cabinet 52, and a door 56 opening closing the open front side of the cabinet 52.

A rack 58 on which tableware is put is provided in the washing chamber 54, and a nozzle 60*a* injecting water via injection holes 60*a* is rotatably provided under the rack 58.

A sump (not shown in the drawing) is provided under the washing chamber 54 to collect water therein. A pump (not shown in the drawing) pumping water to the nozzle 60 and a heater assembly (not shown in the drawing) for heating water held in the sump are provided in the sump.

Moreover, a blower assembly 62 for bowing out humid air in the dishwasher in progress and a detergent box assembly 64 storing a detergent are provided to an inside of the door 56. And, a gasket (not shown in the drawing) is provided to an inner circumference of the door 56 to make the door 56 adhere closely to cabinet 52 when the door 56 is closed.

Meanwhile, a door lock assembly fixing the door 56 to the cabinet 52 is provided to the door 56 and cabinet 52. The door lock assembly stops operating the dishwasher in case that the door 56 is opened as well as fixes the door 56 to the front side of the cabinet 52.

Specifically, the door lock assembly, as shown in FIG. 4, includes a locker 72, a coupling member 74, and a switch assembly 80.

The locker 72 is formed at the door 56, and the coupling member 74 is provided inside the cabinet 52 to be elastically coupled to or separated from the locker 72 when the door is closed or opened.

In this case, the coupling member 74 includes first and second coupling members 74*a* and 74*b* brought into elastic contact with both sides of the locker 72, respectively., when the door 56 is opened/closed. Preferably, the coupling member 74 is constructed with plate springs.

Two pairs of fixing protrusions 76*a* are formed inside the cabinet 52. Both ends, which are bent like a hook, of the first and second coupling members 74*a* and 74*b* are coupled to the fixing protrusions 76*a*, respectively. Moreover, guides 76*b* are provided to circumferences of both of the ends of the first and second coupling members 74*a* and 74*b* to prevent the first and second members 74*a* and 74*b* from being separated from the fixing protrusions 76*a*, respectively.

Meanwhile, incline coupling pieces 73 are formed at both of the sides of the locker 72, and protrusions 75 are formed at central portions of the first and second coupling members 74*a* and 74*b* to be brought elastic contact with the coupling pieces 73, respectively.

In this case, a front end 73*a* of each of the coupling pieces 73 is less slant than a rear end 73*b* thereof. Namely, the front end 73*a* of the coupling piece 73 inclines slow, whereas the rear end 73*b* inclines fast.

Of course, the coupling member 74 can be singly provided. In this case, one side of the locker 72 is brought contact with the coupling member 74 only. Moreover, the coupling piece 73 is formed at one side of the locker 72 only as well as the number of the fixing protrusions 76*a* and guides 76 provided to the door lock assembly is changed.

Meanwhile, the switch assembly 80 is provided in rear of the coupling member 74 to sense the opening/closing of the door 56. For this, the switch assembly 80 includes a micro switch 82 and a button 84.

The micro switch 82 senses the opening/closing of the door 56 to control an operation of the dishwasher. Namely, the micro switch 82 stops the operation of the dishwasher if the door 56 is opened while the dishwasher operates.

And, the button 84 is provided to one side of the micro switch 82 to transfer operational information of the door 56 to the micro switch 82. For this, the button 84 is configured to be brought direct contact with the locker 72 when the door is closed 56. Namely, the button 84 is compressed when the door 56 is closed but is restored when the door 56 is open. Thus, the button 84 controls an operation of the micro switch.

An operation of the above-constructed dishwasher is explained as follows.

Figure 5A:
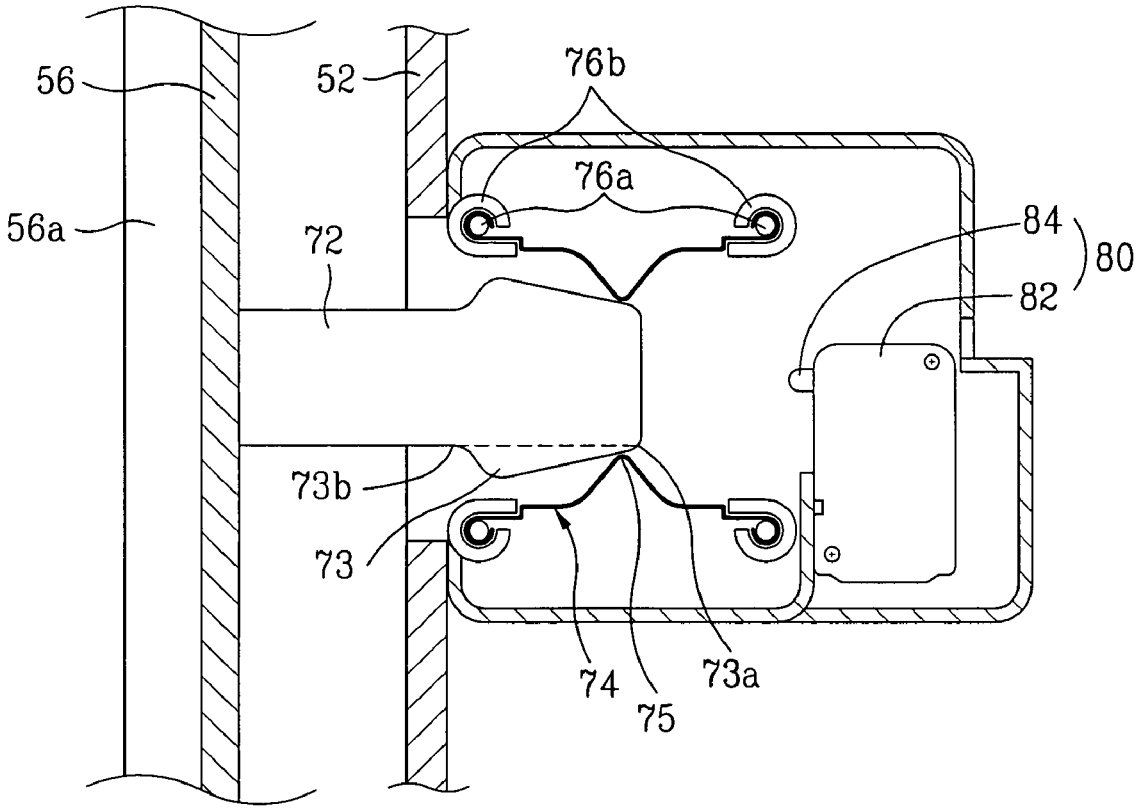
FIGS. 5A to 5C are layouts for explaining an operation of a door lock assembly according to the present invention.
Figure 5B:
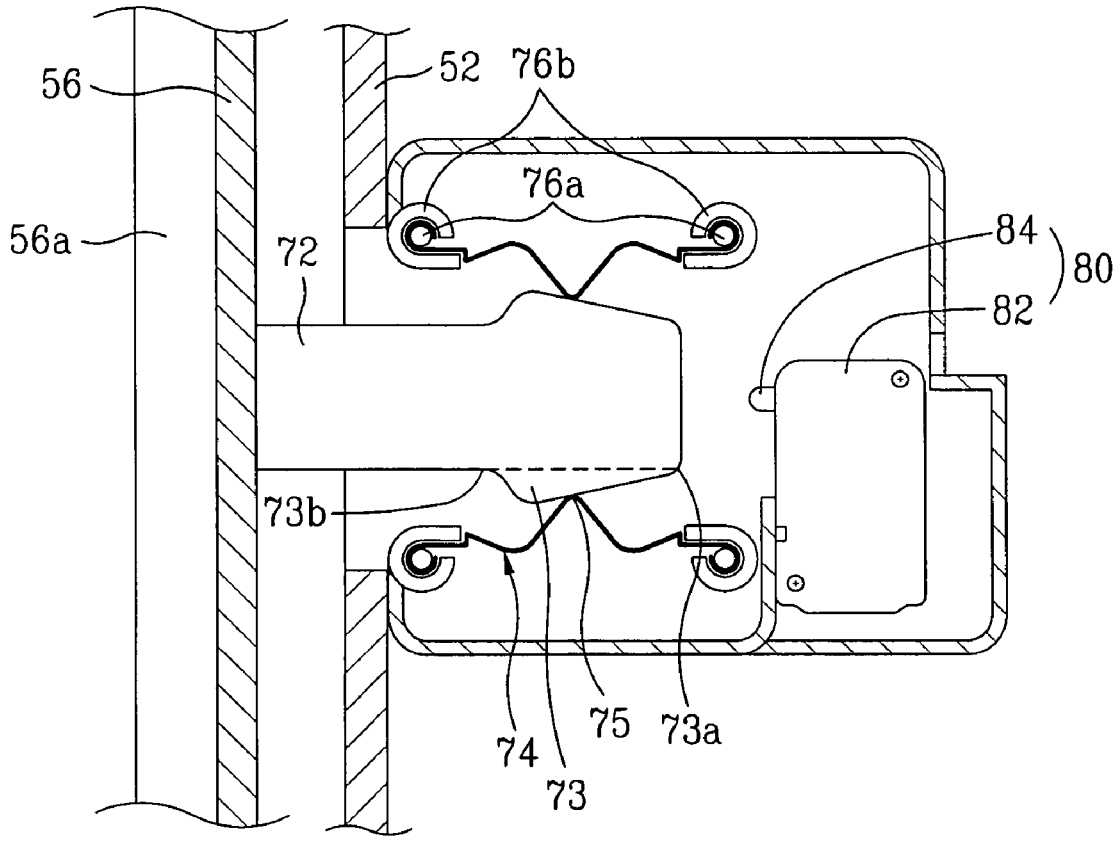
Figure 5C:
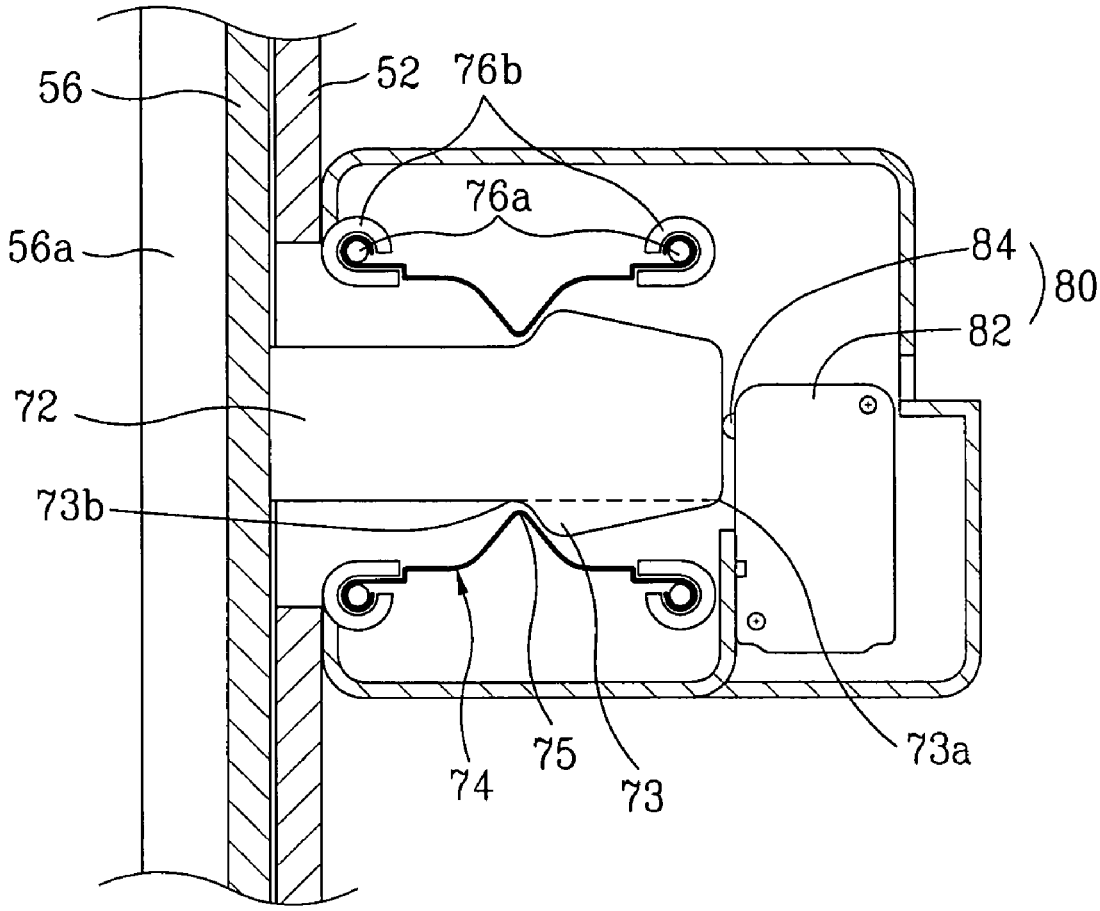

FIGS. 5A to 5C are layouts for explaining an operation of a door lock assembly according to the present invention.

Referring to FIG. 5A, a user holds the grip 56*a* and pushes an upper end of the door 56 toward the cabinet 52 to close the door 56. In doing so, the front end 73*a* of the coupling piece 73 of the locker 72 slides to be brought contact with the corresponding protrusion 75 of the coupling member 74 so that the coupling member 74 is gradually compressed.

Referring to FIG. 5B and FIG. 5C, after the coupling piece 73 of the locker 72 has been contacted with the peak of the protrusion 75 of the coupling member 74, the rear end 73*b* of the coupling piece 73 of the locker 72 is caught on the protrusion 75 of the coupling member 74 so that the door 56 is locked.

In this case, the front end 73*a* of the locker 72 presses the button 84 so that the switch 82 receiving a signal from the button 84 is turned on to sense that the door 56 is locked.

Moreover, in case that the user holds the grip 56*a* to pull the upper end of the door 56 from the cabinet 52 to unlock the door 56, the rear end 73*b* of the coupling piece 73 of the locker 72 slides to be brought contact with the protrusion 75 of the coupling member 74.

In doing so, since the rear end 73*b* of the coupling piece 73 of the locker 72 inclines faster than the front end 73*a* thereof, a more force is needed to open the door 56 than to close the door 56.

Thus, if the door 56 is pulled to open by the force greater than that needed to close, the coupling member 74 is gradually compressed again so that the coupling piece 73 of the locker is brought contact with the peak of the protrusion 75 again.

Thereafter, the protrusion 75 of the coupling piece 74 slides to be brought contact with the front end 73*a* of the locker 72 inclining slow to be restored, and the door 56 is unlocked to be open.

In this case, the front end 73*a* of the locker 72 is separated from the button 84, and the button 84 is then restored to transfer a signal that the door 56 is unlocked to the micro switch 82. The micro switch receiving the corresponding signal from the button 84 is turned off to sense that the door 56 is open.

If the door 56 is opened while the dishwasher is in progress, the micro switch 82 stops driving the dishwasher.

Accordingly, the dishwasher according to the present invention has the following advantages or effects.

First of all, the locker is directly brought into contact with the button provided to one side of the micro switch, thereby providing the simply configured door lock assembly and to reduce the size and number of parts. Therefore, the present invention enables productivity to be enhanced.

Secondly, the locker is elastically locked to or unlocked from the coupling member, whereby the door can be locked/unlocked with a less user's force. Therefore, the present invention provides the user with convenience in use as well as feeling of soft touch.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A dishwasher comprising:

a cabinet having an open front side;

a door opening/closing the front side of the cabinet;

a locker at the door;

a coupling member inside the cabinet to be elastically coupled to or separated from the locker in opening/closing the door; and a switch in rear of the coupling member to sense opening/closing of the door;

wherein the coupling member comprises two separate plate springs, each in the form of a plate so as to exert an elastic force as bent and the switch comprises a button which is directly bought into contact with the locker when the door is closed.

2. The dishwasher as claimed in claim 1, wherein each separate plate spring is adapted to be brought into contact with one side of the locker respeetively.

3. The dishwasher as claimed in claim 2, wherein two pairs of fixing protrusions are formed inside the cabinet and wherein each separate plate spring has two ends, each end being a hooked to a fixing protrusion.

4. The dishwasher as claimed in claim 3, wherein guides are provided to circumferences of both of the ends of each separate plate spring to prevent the separate plate springs from being separated from the fixing protrusions.

5. The dishwasher as claimed in claim 2, wherein a pair of incline coupling pieces are provided to both of the sides of the locker, respectively and wherein a protrusion is located at the center of each separte plate spring and is adapted to be brought into elastic contact with one of the coupling pieces.

6. The dishwasher as claimed in claim 5, wherein a front end of each of the coupling pieces inclines slower than a rear end thereof.

7. The dishwasher as claimed in claim 1, wherein fixing protrusions are formed inside the cabinet and each end of each separate plate spring is hooked to a fixing protrusions.

8. The dishwasher as claimed in claim 7, wherein guides are provided to circumferences of the both ends of each separate plate spring to prevent each separate plate spring from being separated from the fixing protrusion.

9. The dishwasher as claimed in claim 1, wherein an incline coupling piece is provided to one side of the locker and wherein a protrusion brought into sliding contact with the coupling piece is formed at a center of each separate plate spring.

10. The dishwasher as claimed in claim 9, wherein a front end of the coupling piece to be brought into sliding contact with the coupling member inclines slower than a rear end of the coupling piece to be caught on the protrusion of each separate plate spring.

11. A door lock assembly of a dishwasher, comprising:

a locker at a door opening/closing a front side of a cabinet;

a coupling member inside the cabinet, to be elastically coupled to or separated from the locker in opening/closing the door; and a switch in rear of the coupling member to sense opening/closing of the door;

wherein the coupling member comprises two separate plate springs, each in the form of a plate so as to exert an elastic force as bent and the switch comprises a button which is directly bought into contact with the locker when the door is closed.

12. The door lock assembly as claimed in claim 11, wherein each spring plate is adapted to be brought into contact with one side of the locker.

13. The door lock assembly as claimed in claim 11, wherein two pairs of fixing protrusions are formed inside the cabinet and wherein each end of each separate plate spring is hooked to be coupled to a fixing protnision.

14. The door lock assembly as claimed in claim 12, wherein a pair of incline coupling pieces are provided to the both sides of the locker, respectively and wherein a protrusion is located at the center of each separate plate spring and is adapted to be brought into sliding contact with one of the coupling pieces.

* * * * *